United States Patent [19]

Pandak

[11] 4,247,099

[45] Jan. 27, 1981

[54] TENNIS NET CENTER STAY AND MEASURING DEVICE

[76] Inventor: Zoltan I. Pandak, 53054 Dryden, Utica, Mich. 48087

[21] Appl. No.: 973,142

[22] Filed: Dec. 26, 1978

[51] Int. Cl.[3] ..... A63B 61/00

[52] U.S. Cl. ..... 273/29 BA; 33/137 R; 33/169 R

[58] Field of Search ..... 273/29 B, 29 BA, 29 BC, 273/29 R, DIG. 30

[56] References Cited

U.S. PATENT DOCUMENTS

| | | | |
|---|---|---|---|
| 1,239,924 | 9/1917 | Lord | 273/29 BA |
| 1,351,066 | 8/1920 | Robinson | 273/29 BA |
| 1,409,981 | 3/1922 | Vaile | 273/29 BA |
| 1,534,447 | 4/1925 | Hardy | 273/29 BA |
| 3,450,405 | 6/1969 | Mates | 273/29 R |

FOREIGN PATENT DOCUMENTS

| | | | |
|---|---|---|---|
| 375262 | 3/1964 | Switzerland | 273/29 BA |
| 2317 | 2/1888 | United Kingdom | 273/29 BA |
| 109006 | 12/1922 | United Kingdom | 273/29 BA |
| 344615 | 3/1931 | United Kingdom | 273/29 BA |
| 516402 | 1/1940 | United Kingdom | 273/29 BA |

*Primary Examiner*—Anton O. Oechsle
*Assistant Examiner*—T. Brown
*Attorney, Agent, or Firm*—Remy J. VanOphem

[57] ABSTRACT

A tennis net center strap is positioned over the center of a tennis net for anchoring to a mount in the playing surface of the tennis court. The strap is adjustable so that the height of the net may be set at 36 inches regardless of whether the mount for the tennis court surface is disposed above, below, or flush with the surface of the tennis court. An indicator mark is positioned 36 inches from one end of the strap. The other end of the strap is passed through a retaining ring and under the net and the strap is secured to the mount. Thereafter, the opposite end of the strap is secured to the 36 inch portion between the indicator mark and the first end of the net such that the indicator mark is atop the net and the first end of the strap just touches the ground thereby adjusting the net to an exact 36 inch height without the use of another measuring device. In this manner, the strap may be used on any tennis net at a court with a mount so as to adjust the height of the tennis net to 36 inches without the use of external measuring devices and regardless of the height of the mount above or below the surface of the tennis court.

11 Claims, 4 Drawing Figures

B
A
2
2
24
22
10
20
26
12
18
16
14
30
28

22
10
20
12
26
30
29
32
18
16
14
28

TENNIS NET CENTER STAY AND MEASURING DEVICE

BACKGROUND OF THE INVENTION

1. Field of the Invention

The present invention deals with tennis net equipment particularly straps for adjusting the height of a tennis net. The present invention also deals with portable net straps which may be used on any tennis net with any tennis court surface having a mount for securing the strap to the court surface.

2. Description of the Prior Art

The game of tennis requires a net stretched across the playing surface in a vertical position at the center of the tennis court from side to side. The end posts supporting the net are positioned outside the sidelines at a height of 42 inches. However, the center of the net is always to be positioned at a height 36 inches above the playing surface of the tennis court.

Many tennis courts, both indoor and outdoor, feature mounts at the center of the court, which mounts are provided to secure a strap about the center of the tennis net so as to adjust the height of the tennis net. These mounts may be staked, cemented, or otherwise sunk in the surface of the tennis court so as to rigidly fix the mount. However, depending upon the type and method of installation of the mount, the point where a tennis net strap attaches to the mount may be somewhat above or below the surface of the tennis court. This creates problems resulting in incorrect measurement.

The game of tennis requires an exact measurement of the height of the center of the net from the surface of the tennis court. If the height of the net is somewhat greater than 36 inches, then an otherwise good tennis shot may strike the top of the net and fall rather than pass to the opposite court. It the net is adjusted such that the top center of the net is somewhat less than 36 inches, then a player's opponent may be able to hit shots into the players court, which shots would otherwise not pass over the net. Even a slight mismeasurement of $\frac{1}{4}$ inch or $\frac{1}{2}$ inch can make a significant difference in the scoring of the tennis match, especially for experienced players who practice to assure that some shots pass over the net no higher than necessary. Therefore, these players often measure the height of the center of the net to assure that it is precisely 36 inches. This often requires the use of a yard stick or other measuring device which must be brought to the center court to determine the correct height of the net. Many devices have been proposed to aid in net height adjustment.

Bunker, in U.S. Pat. No. 2,296,086 discloses tennis net center band attaching equipment for securing the center of the net to center court and device to overcome the unnecessary gathering of the center of the net at the bottom thereof.

Hardy, in U.S. Pat. No. 1,534,447 shows a strap and attaching buckle for securing the strap over a tennis net to the tennis court mount at the surface of the court. The hook presented by Hardy facilitates securing and releasing the strap from the tennis court surface mount.

Vaile, in U.S. Pat. No. 1,409,981 shows a center stay or tennis nets which is designed to automatically adjust the height of the tennis net to 36 inches above the playing surface. The invention disclosed by Vaile, however, presumes that the tennis court surface mount is disposed such that the net will be positioned at exactly 36 inches when the attaching hook is secured to the mount. Of course, this is contrary to many modern tennis courts where the height or depth of the surface mount at the center of the tenis court may vary as much as several inches from the court surface. Vaile shows no adjustability of the tennis net strap which is required by today's tennis court surfaces and strap mounts.

Robinson, in U.S. Pat. No. 1,351,066 shows an adjustable tennis net strap with buckle device and chain anchoring device. The device disclosed therein is adjustable to the proper 36 inch height of the tennis net when the chain mounting has been appropriately inserted in the tennis court surface and the distance of open link 13 above the court surface is determined. The patent states that the strap (band) is provided with suitably disposed visual indicating means whereby the extent of the adjustment by moving the buckle device can be readily and accurately determined without recourse to a separate measure. This is true, however, only when the height of the chain mount has been determined by using a separate measure. Of course, this device is not useable with a hard surface where a strap mount is already located in the tennis court surface. This device always requires measurement upon installation of the tennis net strap and anchor.

Davis, in U.S. Pat. No. 3,549,146 discloses an anchoring device with a built-in measuring rod which is usable to locate the height of the net at 36 inches when the anchoring device has been properly inserted in the tennis court surface. As with Robinson, the device disclosed by Davis is not usable in a hard surface which has a built-in mount for the tennis net strap. The device of Davis must be mounted in the tennis court surface.

None of the devices of the prior art show a device overcoming all of the problems in the prior art as has been done in this invention. The present invention provides a time saving, portable, low cost device, not requiring its own mount. None of the devices of the prior art contain all of these features and none disclose such a measuring device.

None of the devices in the prior art show a tennis net center strap with the capabilities to adjust and set the height of the tennis net at 36 inches regardless of what height the mount for the strap is set in the tennis court surface. That is, none of the known tennis net center bands and attaching equipment are adaptable to different tennis court surfaces such that some type of measurement must be made to assure that the net is at the proper height.

Therefore, players have often used the method of placing the width of a tennis racquet head on top the length of another tennis racquet to estimate 36 inches for the height of the tennis net. The only alternative to adjusting the tennis net on a court where a mount built into the tennis court surface is to use a yard stick or other device external to the tennis court for measuring the height of the net. This, of course, constitutes a disadvantage, in that, a player must carry a yard stick or other measuring device to the tennis court so as to check the proper height of the tennis net. Since modern tennis courts have strap mounts positioned somewhat above or below the court surface, one of the above mentioned techniques is normally used to align the tennis net. This takes additional time, effort, and materials, thereby detracting from the time available for playing the game. This is especially disadvantageous where players pay an hourly rate for the use of the court.

SUMMARY OF THE INVENTION

The present invention overcomes the difficulties and disadvantages of the prior art by providing a tennis net center strap device with a built-in measuring device which is part of the tennis net strap and is usable on any tennis court having a mount located at the center of the surface of the court. The device of the present invention is usable regardless of whether the mount is positioned somewhat above or below the surface of the tennis court.

According to the invention, a tennis net center strap of greater than 72 inches encircles the tennis net and is secured at the bottom of the strap by any fastening device known in the art and is connected to the mount at the center of the tennis court. The strap is then adjustable such that it may be secured in a position where an indicator mark is indexed atop the net and a free end of the strap extends to the surface of the tennis court, the distance between the indicator mark and the free end of the strap being exactly 36 inches. In this manner, the tennis net center strap may be secured to the court surface mount and the strap may then be adjusted, thereby adjusting the height of the tennis net, so as to position the indicator mark atop the net with the free end of the strap extending just to the surface of the tennis court.

The fastening device is conveniently an oval slip ring disposed about the strap body such that the strap body does not gather or bunch when the assembly is tied or otherwise fastened to the mount.

It is therefore an object of the present invention to provide a portable tennis net center strap which is usable on any tennis court having a mount at the center of the court surface securing the net and strap to the court surface, regardless of the position of the mount above or below the court surface.

It is also an object of the present invention to provide a tennis net center strap which is inexpensive to produce, not requiring a special mount or special strap materials.

It is also an object of the present invention to provide a tennis net center strap which is quickly and easily mounted upon a tennis net at a tennis court and is thereafter easily adjustable to position the height of the tennis net at 36 inches without the use of external measuring means.

It is also an object of the present invention to provide a tennis net center strap measuring device which saves time for players.

It is also an object of the present invention to provide a net center strap usable with any mount.

DESCRIPTION OF THE PREFERRED EMBODIMENT

Figure 1:
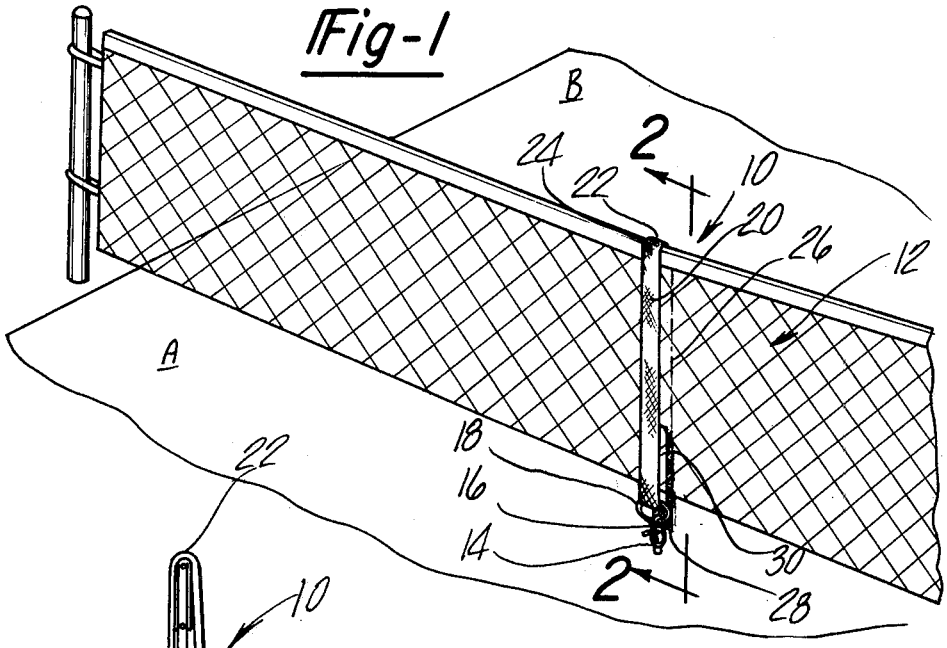
FIG. 1 is a perspective view of the tennis net center strap installed on the tennis net at the center of the tennis court.

The tennis net center strap device 10 according to the invention is shown in FIG. 1, as installed on a tennis net 12 between court A and an opposite court B. The tennis court has embedded therein a net strap mount 14 provided to secure the strap assembly 10 and 12 at the center of the court so that the net does not sway and such that the net may be adjusted to the proper height of 36 inches.

Additional examples of tennis court surface mounts are shown in FIG. 3 with typical differences in elevation from the court surface shown. The device according to the present invention has any known fastening device, for example twine 16 which may be used to secure the net strap assembly 10 to any type of mount having an aperture, loop, or other member where the strap may be fastened.

Figure 2:
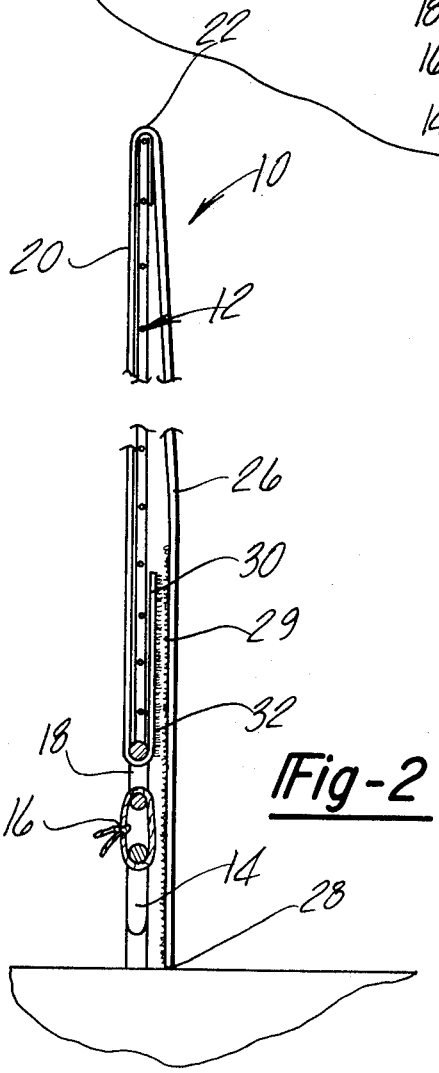
FIG. 2 is a sectional side view of the tennis net center strap positioned on the tennis net over a court having a mount above the court surface.
Figure 3A:
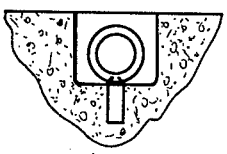
FIG. 3A illustrates a mount below the court surface.
Figure 3B:
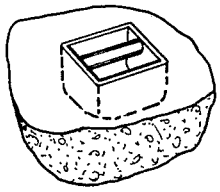
FIG. 3B illustrates a mount flush with the court surface.

Whether the mount is above the court surface as in FIG. 2, flush with the surface as in FIG. 3B or sunken beneath the surface as in FIG. 3A, the device is fastened to the mount and thereafter adjusted to the proper height.

A slip ring 18 is passed loosely around the strap body 20 and the twine 16 is secured to the adjustable ring 18. The ring 18 is provided to secure the net 12 and strap assembly 10 in position to the mount 14. An indicator mark 22 is shown on the strap body 20 near the top of the net 12.

It is possible to add additional indicator marks 24 such as shown in FIG. 1 since it may be desirable to set the net at a somewhat higher or lower level for practice purposes. Beginning players may desire to lower the net about an inch so as to be able to play more shots than would normally cross the net. Intermediate players may desire to set the net somewhat higher than the standard 36 inch height in order to force them to make more consistent safe shots to the opposite court.

The strap device has a 36 inch portion 26 extending from the indicator mark 22 to a first end 28 of the strap. A significant part of this 36 inch portion 26 has an adhesive material 29 attached on the inside thereof, for a length of, for example, 18 inches extending from the center of portion 26 to about the first end 28. The second end 30 of the strap body 20 has a hook material 32, provided on the outside thereof for mating engagement with the loop adhesive material 29 on the inside of the portion 26 near the first end 28. The hook 32 and loop 29 mating materials are conveniently made of the nylon product commonly known as Velcro, which is a trademark of the Velcro Corporation. The nylon Velcro fastener forms a convenient, rapidly fastened method for adjusting the tennis net center strap assembly 10. Of course, it should be recognized that a buckle or other equivalent device could be used with the mating parts positioned on the inside of portion 26 and the outside of the second end 30. The Velcro material permits the fast measurement and installation of the device 10.

Velcro fastening surfaces and other devices allowing an infinite number of adjustable positions are most desirable since the net can then be adjusted to an exact height of 36 inches. In comparison, a belt buckle on the first end of the strap and holes in the second end of the strap consititutes a situation where not all positions are available and an exact 36 inch height may not be achieved without carefully fastening the strap to the court mount.

FIG. 2 shows the mating surface 29 of the portion 26 and mating surface 32 of the second end portion 30, appropriately attached on the device, indicating the easy adjustment of the center strap assembly 10. The mount 14 shown in FIG. 2 is an example of a mount extending somewhat above the surface of the tennis court.

OPERATION

The center strap assembly 10 should be positioned over a taut tennis net 12 at the center of the tennis court surface above the mount 14 in a tennis court surface. The strap body 20 should be positioned over the net 12 such that the indicator mark is somewhat below the top of the net on the side opposite where the first end 28 extends downwardly. With the strap assembly 10 in this position and with the movable ring 18 dangling at the bottom of the strap body 20 as shown in FIG. 2, the twine or any convenient attaching means 16 is passed through the ring 18, then through the mount 14, and tied. A snap ring could also be used.

The second end 30 is then held up on the same side of the net as the 36 inch portion 26 such that the matching securing surfaces 32 and 29, buckle assembly, or other equivalent device are in position to be secured. The strap body 20 is then pulled down from the first end 28 such that the first end 28 reaches just flush with the court surface. The second end 30 is then pulled up until the indicator mark 22 rests squarely atop the net 12. The Velcro mating surfaces 29 and 32 are then pressed together to secure the strap body in position and thereby secure the taut net at the exact height of 36 inches without the use of additional measuring devices. Of course, a different exact height can be set by positioning an alternate mark atop the net.

As can be seen from the above description, it is a simple and quick task to place the strap assembly 10 over a tennis net passing the second end 30 under the net, tying off the assembly to the mount 14 with the twine 16 through the loop 18, and securing the Velcro fasteners in position. The indicator mark is atop the net with the first end 28 of the strap body 20 flush to the court surface.

Assembly of the strap body assembly 10 in this manner, or adjustment in this manner where the assembly 10 is already installed on the court, has proven to be a great time saver for tennis players at the beginning of a match, allowing them more time to play tennis and requiring less time in adjustment of the net. This is especially important where the players are paying for use of the court at an hourly rate.

Since the strap assembly 10 is portable, it can be easily detached from the mount 14 and the net 12 after the play is concluded. Thereafter, the owner of the strap assembly 10 may take the device with him to any tennis location and assemble the device on any tennis court where a mount is available at the center court surface or where a portable mount may be easily installed. With the inventive device, the players need not carry a yard stick or measuring tape with them to measure the height of the net for each court used.

This portable assembly 10 is especially useful for indoor hard surface courts now used thorughout the country, especially in the winter time, since these courts often have permanent mounts at the center of the tennis court for securing the net at the proper height. Of course, as mentioned earlier, the problem with such locations is that the elevation of the mount above or below the surface of the court varies.

Having described my invention according to the preferred embodiment, it should be noted that one skilled in the art can vary the fastening technique, materials of the strap body, method of securing the strap body to the mount, or other features of the invention without departing from the scope and spirit of the invention disclosed herein and claimed in the appended claims.

Therefore, what I claim is:

1. An adjustable measuring device for adjusting the height of a vertical net to a predetermined distance above a horizontal surface comprising:

a strap for encircling said vertical net, said strap having at least one indicator mark, a first end portion, and a second end portion, said strap further having a first predetermined distance portion measured from the end of said first end portion to said at least one indicator mark;

means for adjustably securing and maintaining said second end portion of said strap to said first predetermined distance portion of said strap at a plurality of locations; and means for fastening said strap to said horizontal surface, said fastening means movably attached to said second end portion of said strap and defining a second predetermined distance portion intermediate said first and second end portions such that when said measuring device is attached to said vertical net, said first predetermined distance portion extends from said horizontal surface upwardly on one side of said vertical net to said at least one indicator mark aligned with the top of the net, said second predetermined distance portion of said strap extends from said at least one indicator mark downwardly on the other side of said vertical net to said fastening means and further extends from said fastening means around the bottom of said vertical net to the end of said strap said securing means further being adjusted to position said at least one indicator mark atop said vertical net when the end of said first end portion is flush to said horizontal surface, said securing means further securing said second end portion to said first predetermined distance portion at a location intermediate said indicator mark and said first end portion thereby holding said vertical net at said predetermined distance above said horizontal surface.

2. A device according to claim 1 wherein said first predetermined distance portion is between 32 and 40 inches.

3. A device according to claim 2 wherein said first predetermined distance portion is 36 inches.

4. A device according to claim 1 wherein said fastening means comprises a slip ring movably positioned about said strap and a piece of cord whereby said strap may be secured to said horizontal surface.

5. A device according to claim 1 wherein said net is a tennis net, said horizontal surface is a tennis court, and said horizontal surface has a mount positioned in the center of said court.

6. A device according to claim 1 wherein said securing means comprises a belt buckle and mating section disposed on said strap.

7. A device according to claim 1 wherein said securing means comprises mating Velcro fastening faces, one of said faces being attached to the inside of said first end portion and the other of said faces being attached to the outside of said second end portion.

8. A tennis net center strap for adjusting the top of a tennis net above a tennis court surface having a mount located at center court to secure said device, the device comprising:

a strap having a first end portion, a second end portion, and at least one indicator mark intermediate said first and second end portions, said at least one indicator mark further being located a predetermined distance from the end of said first end portion, said strap further having a predetermined distance portion extending from the end of said first end portion to said at least one indicator mark;

means for adjustably securing said second end portion of said strap to said predetermined distance portion of said strap; and means for fastening said strap to said mount located at center court, said fastening means being secured on said second end portion and movably attached to said first end portion of said strap such that when said device is attached to said tennis net, said first predetermined distance portion extends from said surface of said tennis court upwardly on one side of said tennis net to said at least one indicator mark aligned with the top of the net, said second predetermined distance portion of said strap extends from said at least one indicator mark downwardly on the other side of said tennis net to said fastening means and further extends from said fastening means around the bottom of said tennis net to the end of said strap, said securing means further being adjusted to position said at least one indicator mark atop said tennis net when the end of said first end portion is flush to said surface of said tennis court, said securing means further securing said second end portion to said first predetermined distance portion at a location intermediate said at least one indicator mark and the end of said first end portion thereby holding the top of the tennis net at said predetermined distance above said surface of said tennis court.

9. A device according to claim 8 wherein said predetermined distance is 36 inches.

10. A device according to claim 8 wherein said securing means comprises mating Velcro fastening surfaces, with one of said surfaces attached to the inside of said first end portion and the other of said surfaces attached to the outside of said second end portion.

11. A method of adjusting the top of a vertical net to a predetermined distance above a horizontal surface, comprising the steps of:

encircling the vertical net with a strap, said strap having a first end portion, a second end portion, at least one indicator mark intermediate said first and second end portions and located a predetermined distance from the end of said first portion and a predetermined distance portion measured from the end of said first end portion to said at least one indicator mark;

adjustably fastening said strap to said horizontal surface whereby said strap is movably attached to said vertical net without unfastening said strap from said horizontal surface; and adjustably securing said second end portion of said strap to said predetermined distance portion intermediate said first end portion and the top of the net such that said at least one indicator mark is positioned atop of said vertical net and the end of said first end portion is positioned flush to said horizontal surface thereby maintaining the top of said net at said predetermined distance above said horizontal surface.

* * * * *

UNITED STATES PATENT OFFICE

CERTIFICATE OF CORRECTION

Patent No. 4,247,099 Dated January 27, 1981

Inventor(s) Zoltan I. Pandak

It is certified that error appears in the above-identified patent and that said Letters Patent are hereby corrected as shown below:

Column 1, line 37, delete the word "It" and insert therefor ----If----.

Column 1, line 63, delete the word "nets" and insert therefor ----net----.

Column 2, line 3, delete the word "tenis" and insert therefor ----tennis----.

Signed and Sealed this

*Eleventh* Day of *August 1981*

[SEAL]

*Attest:*

GERALD J. MOSSINGHOFF

*Attesting Officer*

*Commissioner of Patents and Trademarks*